United States Patent [19]

Bomberger et al.

[11] Patent Number: 4,534,938

[45] Date of Patent: Aug. 13, 1985

[54] METHOD FOR MAKING ALLOY ADDITIONS TO BASE METALS HAVING HIGHER MELTING POINTS

[75] Inventors: Howard B. Bomberger, Canfield; Francis H. Froes, Xenia, both of Ohio

[73] Assignee: The United States of America as represented by the Secretary of the Air Force, Washington, D.C.

[21] Appl. No.: 640,916

[22] Filed: Aug. 15, 1984

[51] Int. Cl.[3] ..... C22C 1/03; C22C 9/00; C22C 14/00; C22C 30/00

[52] U.S. Cl. ..... 420/590; 420/417; 420/492; 420/580

[58] Field of Search ..... 420/417, 418, 590, 422, 420/427, 428, 425, 430, 580, 492, 494; 75/52, 56; 148/422, 423

[56] References Cited

U.S. PATENT DOCUMENTS

| | | | |
|---|---|---|---|
| 1,636,763 | 7/1927 | Boving | 420/590 |
| 1,916,410 | 7/1933 | Brace | 420/590 |
| 2,138,459 | 11/1938 | Pfeil | 420/590 |
| 2,813,791 | 11/1957 | Gullett | 420/417 |
| 2,837,425 | 6/1958 | Vordahl | 420/422 |
| 3,392,016 | 7/1968 | Opie et al. | 420/492 |
| 3,432,292 | 3/1969 | White | 420/428 |
| 3,563,730 | 2/1971 | Bach et al. | 420/590 |
| 3,574,569 | 4/1971 | Vordahl | 420/418 |
| 4,248,630 | 2/1981 | Balmuth | 420/590 |
| 4,451,430 | 5/1984 | Matidori et al. | 420/492 |

FOREIGN PATENT DOCUMENTS

| | | | |
|---|---|---|---|
| 441321 | 9/1974 | U.S.S.R. | 420/417 |

*Primary Examiner*—Peter K. Skiff

*Attorney, Agent, or Firm*—Donald J. Singer; Charles E. Bricker

[57] ABSTRACT

A method for adding alloying elements having relatively low boiling points to base metal shaving relatively high melting points. The base metal is combined with the melting point-lowering metal; or metalloid and to this mixture is added the desired alloying metal or metals. No special equipment is required for this method.

15 Claims, No Drawings

METHOD FOR MAKING ALLOY ADDITIONS TO BASE METALS HAVING HIGHER MELTING POINTS

RIGHTS OF THE GOVERNMENT

The invention described herein may be manufactured and used by or for the Government of the United States for all governmental purposes without the payment of any royalty.

BACKGROUND OF THE INVENTION

This invention relates to methods for making alloys, and particularly to a method for alloying a metal having a relatively low boiling point with more refractory metals.

There is a constant need to improve materials. In the aerospace industry considerable emphasis is placed on the strength-to-weight ratio of materials. Generally, past efforts to improve this ratio have been directed to improving strength, with little attention given to lowering the density of alloys.

More recently, research has been directed toward lowering the density of alloys. Balmuth, U.S. Pat. No. 4,248,630 discloses the alloying of lithium with aluminum by establishing a bath of molten Al, adding all alloying elements to the bath except the Li, treating the alloy melt to remove hydrogen and adding the Li to the alloy melt. The resulting alloy is said to possess lower density along with a higher modulus of stiffness.

Additions, including Li, Mg, Ca, Ba and Zn can be made readily to Al and other metals having melting points less than the boiling points of the addition metals. Difficulties increase, however, when trying to alloy such low melting point elements with more refractory metals and alloys. Generally, the low melting point elements tend to boil away as the temperature is raised to melt the more refractory materials. For example, the melting point of Ti is about 1680° C. while the boiling point of Li is about 1335° C. It would appear that merely combining Li and Ti in a crucible, then heating the crucible, would boil off the Li before the Ti beings to melt. Attempts have been made to avoid this problem using complex, expensive, pressurized melting equipment. What is desired is a simpler, less expensive process for reducing the density of the more refractory metals.

Accordingly, it is an object of the present invention to provide a process for producing alloys of metals having relatively low boiling points with the more refractory metals.

Other objects, aspects and advantages of the present invention will be apparent to those skilled in the art.

DESCRIPTION OF THE INVENTION

In accordance with the present invention there is provided a process for alloying at least one first metal having a density less than 7.2 g/cc and a melting point below 900° C. with a base metal having a density greater than 1.8 g/cc and a melting point greater than 1000° C., which comprises forming a composition of at least one of the base metals with a melting point lowering amount of a melting point-lowering metal or -metalloid selected from the group consisting of Cu, Ni, Co, Fe, Si and Be, wherein the resulting composition has a melting point less than the boiling point of the desired first metal, adding the first metal to the melted composition and thereafter solidifying the resulting alloy.

The first metals included within the scope of this invention are selected from the group consisting of Ba, Ca, Li, Mg and Zn. Each of these metals has a relatively low boiling point and, with the exception of Zn, a relatively low density.

The more refractory base metals included within the scope of this invention are selected from the group consisting of Groups IB, IVB, VB, VIB and VIII of the Periodic Table of the Elements. Of particular interest are Cu from IB, Ti and Zr from IVB, Nb and Ta from VB, Cr and W from VIB and Fe, Co and Ni from VIII.

The alloys of the present invention are produced by first alloying a desired base metal with about 3 to 50 weight percent, preferably about 3 to 10 weight percent, of the melting point-lowering element to provide a first alloy and then alloying a desired first metal with the first alloy to provide a second alloy. No special equipment is required in order to carry out the method of this invention. However, in view of the relative toxicity of beryllium and the reactivity of lithium, it is preferred to carry out the process under an inert, dry atmosphere. Suitable atmospheres include He, Ne, Ar and Xe. The amount of the first element can range from about 0.5 to about 15 weight percent, preferably about 3 to 7 weight percent, based upon the base metal.

The present invention provides a solution to the difficult problem of incorporating metals having low boiling points into other metals having relatively high melting temperatures, without substantial loss of the low boiling point metals.

The following example illustrates the invention:

EXAMPLE

Samples were prepared in a horizontal tube furnace provided with seals and an argon feed system. A boat-type crucible was used to contain the melt. Previously prepared master alloys employed were as follows:

A. Ti-4.5Be
B. Ti-7.5Be
C. Ti-47.5Zr-5Be
D. Ti-50Cu

Approximately 40 g of each of the above master alloys was used in each of the following experimental runs. Each sample was washed with acetone, dried and weighed, then placed in the crucible which was then placed in the furnace at room temperature.

A desired quantity of lithium was cleaned by removing surface oxides or other foreign material, then weighed and promptly placed in the argon filled furnace tube. The lithium was placed in the cold end of the furnace for later addition to the Ti alloy after the latter was molten.

A desired quantity of magnesium was washed with acetone, dried and placed in the argon filled furnace tube.

The furnace tube was closed then flushed with argon for several minutes before heating the furnace. The furnace was then rapidly heated to about 1850° F. (1000° C.) to melt the master alloy. Upon achieving 1850° F. the Li (or Mg) was added to the alloy melt. The furnace temperature was maintained at about 1850° F. for 4 to 5 minutes. The furnace was cooled to 600° F. or lower, then opened.

Specific alloys prepared are given in the following table:

TABLE

| Alloy Weight % (approximate) | Maximum Furnace Temperature, °C., (approximate) | Density g/cc |
|---|---|---|
| Ti-4.5Be-3Li | 1150 | 3.47 |
| Ti-7.5Be-3Li | 1120 | 3.37 |
| Ti-7.5Be-5Mg | 1090 | 3.79 |
| Ti-50Cu-3Li | 1075 | 4.73 |
| Ti-47.5Zr-5Be-3Li | 1050 | 3.91 |

Various modifications may be made in the present invention without departing from the spirit and scope of the instant disclosure.

We claim:

1. A method for alloying at least one first metal having a density less than 7.2 g/cc and a melting point below 900° C. with a base metal having a density greater than 1.8 g/cc and a melting point greater 1000° C., said base metal comprising one or more metals selected from the group consisting of Ti, Zr, Nb, Ta, Cr and W, which comprises forming a composition of said base metal with a melting point lowering amount of a melting point-lowering element, whereby the resulting composition has a melting point below the boiling point of said first metal, melting said composition and mixing said first element therewith, and solidifying the resulting alloy.

2. The method of claim 1, wherein said melting point-lowering element is selected from the group consisting of Cu, Ni, Co, Fe, Si and Be and said first metal is selected from the group consisting of Ba, Ca, Li, Mg and Zn.

3. The method of claim 2 wherein said base metal is Ti.

4. The method of claim 3 wherein said melting point lowering element is Be.

5. The method of claim 4 wherein said first metal is Li.

6. The method of claim 4 wherein said first metal is Mg.

7. The method of claim 3 wherein said melting point lowering element is Cu and said first metal is Li.

8. The method of claim 2 wherein said base metal is a mixture of Ti and Zr, wherein said melting point lowering element is Be and said first metal is Li.

9. The method of claim 1 wherein the amount of said melting point lowering element is in the approximate range of 3 to 50 weight percent and the amount of said first metal is in the approximate range of 0.5 to 15 weight percent.

10. The method of claim 1 wherein the amount of said melting point lowering element is in the approximate range of 3 to 10 weight percent and the amount of said first metal is in the approximate range of 3 to 7 weight percent.

11. The composition of matter Ti-4.5Be-3Li.

12. The composition of matter Ti-7.5Be-3Li.

13. The composition of matter Ti-7.5Be-5Mg.

14. The composition of matter Ti-50Cu-3Li.

15. The composition of matter Ti-47.5Zr-5Be-3Li.

* * * * *